United States Patent [19]

Stratton et al.

[11] 3,931,932

[45] Jan. 13, 1976

[54] LIQUID SPRAYER

[75] Inventors: John Frederick Stratton, Great Harwood; Thomas Haddow, Burnley; Eric Gates, Barrowford, all of England

[73] Assignee: Lucas Aerospace Limited, Birmingham, England

[22] Filed: July 5, 1974

[21] Appl. No.: 485,974

[30] Foreign Application Priority Data

July 12, 1973 United Kingdom ..... 33338/73

[52] U.S. Cl. ..... 239/431; 239/434; 239/594

[51] Int. Cl.[2] ..... B05B 7/00

[58] Field of Search ..... 239/424.5, 426, 430, 433, 239/431, 434, 434.5, 592, 594, 553, 597, 318, 351

[56] References Cited

UNITED STATES PATENTS

| | | | |
|---|---|---|---|
| 469,211 | 2/1892 | Kline | 239/592 X |
| 1,143,792 | 6/1915 | Smith | 239/592 X |
| 1,445,208 | 2/1923 | Forward | 239/592 |
| 2,804,919 | 9/1957 | Kinnison | 239/431 X |
| 3,642,211 | 2/1972 | Place | 239/597 X |
| 3,834,627 | 9/1974 | Watkins | 239/430 |

*Primary Examiner*—John J. Love

*Attorney, Agent, or Firm*—Olson, Trexler, Wolters, Bushnell & Fosse, Ltd.

[57] ABSTRACT

A liquid sprayer for a gas turbine engine comprises a body formed with one or more air passages therein and one or more fuel passages. The fuel passages open into the air passages over portions thereof whose dimensions change smoothly and continuously longitudinally of the passage. Each air passage may be of rectangular cross-section over said portion with the cross-sectional shape thereof changing from one dimension being smaller than the other to said one dimension being greater than the other. The fuel passage opens into the air passage at a location at which the two dimensions are substantially the same.

This liquid sprayer device promotes efficient mixing of the fuel with the air.

5 Claims, 18 Drawing Figures

LIQUID SPRAYER

This invention relates to liquid sprayers and is particularly, but not exclusively, concerned with liquid sprayers for use in gas turbine engines.

According to the present invention, there is provided a liquid sprayer comprising a first passage through which, in use, gaseous fluid passes, and a second passage through which, in use, liquid passes, said second passage opening into a portion of the first passage whose cross-sectional shape changes longitudinally of the passage.

The first passage may have a cross-sectional area which increases from an intermediate region to an outlet plane.

The cross-sectional area of the first passage may decrease from an inlet plane to the intermediate region.

The second passage may open into the intermediate region of the first passage.

Preferably, the cross-sectional shape changes from one dimension thereof being smaller than the other dimension to the said one dimension being greater than the said other dimension.

The second passage may open into the first passage at a location at which the said one dimension is substantially the same as the said other dimension.

It is preferred to arrange the said portion of the first passage to vary continuously and smoothly in cross-sectional shape.

Advantageously, the passage is of changing rectangular cross-section.

The liquid sprayer must include more than one first passage and more than one second passage associated therewith.

Embodiments of the present invention will now be described, by way of example, with reference to the accompanying drawings, in which.

Figure 1:
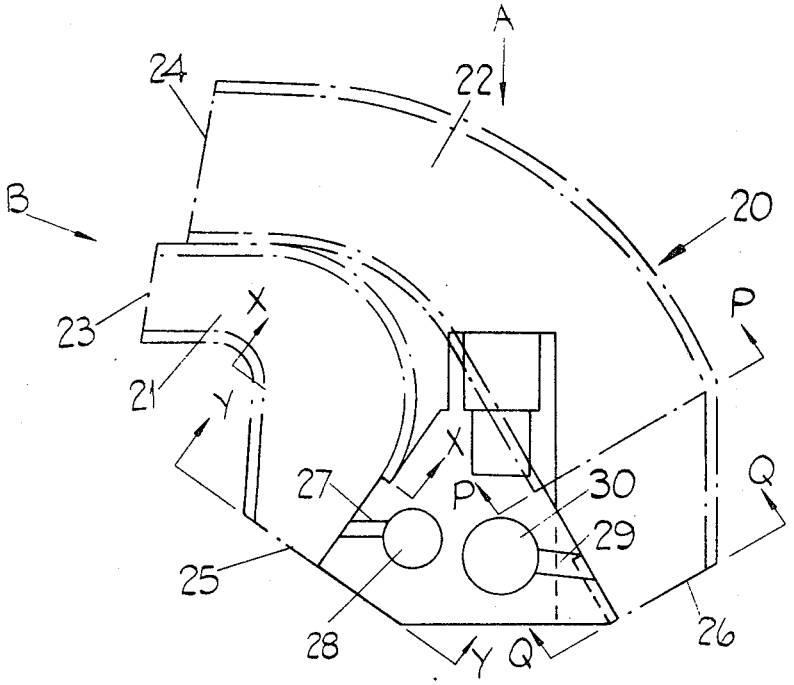
FIG. 1 is a sectional view of one form of liquid sprayer according to the present invention.
Figure 2:
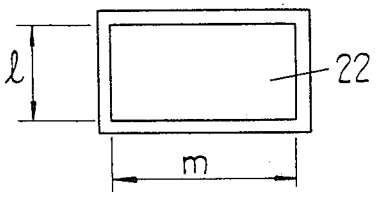
FIG. 2 is a section on the line P—P of FIG. 1.
Figure 4:
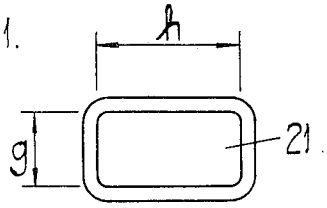
FIG. 4 is a section on the line X—X of FIG. 1.
Figure 3:
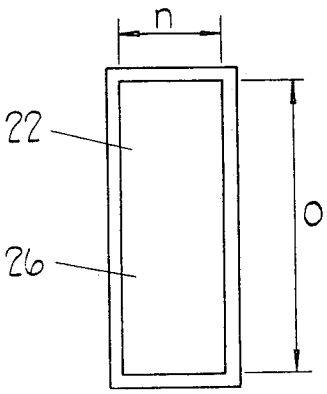
FIG. 3 is a section on the line Q—Q of FIG. 1.
Figure 5:
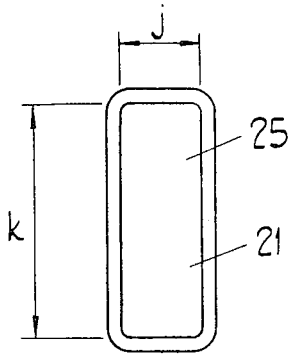
FIG. 5 is a section on the line Y—Y of FIG. 1.
Figure 6:
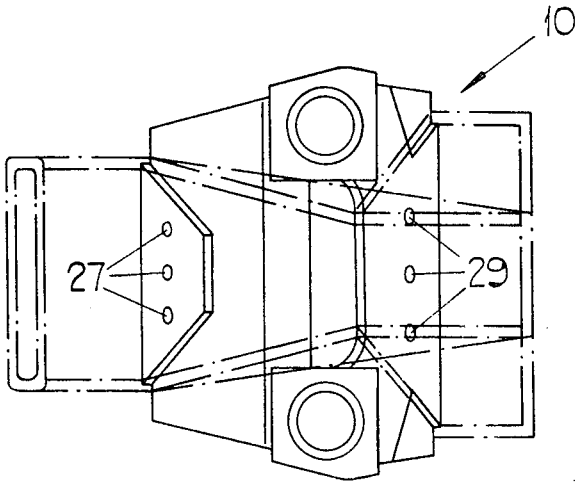
FIG. 6 is a view in the direction of arrow A of the liquid sprayer in FIG. 1.
Figure 7:
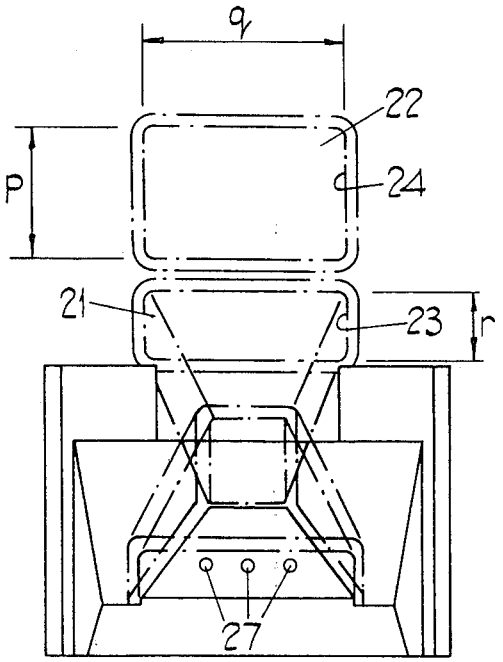
Figure 8:
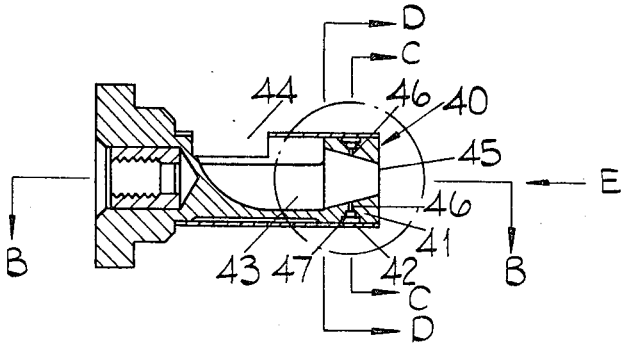
Figure 9:
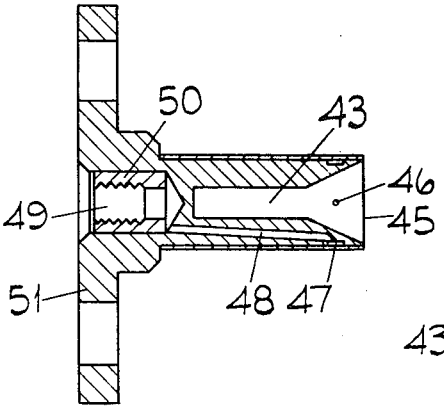
Figure 10:
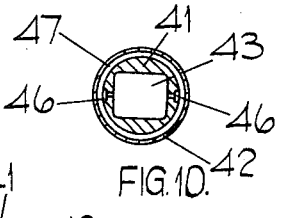
Figure 12:
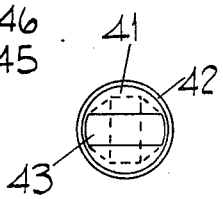
Figure 11:
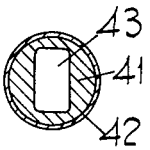
Figure 13:
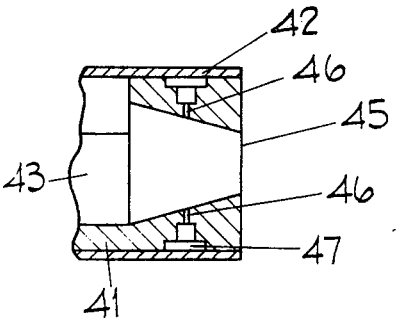
Figure 14:
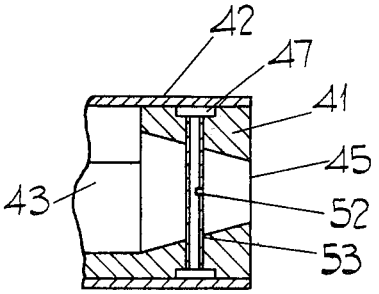
Figure 15:
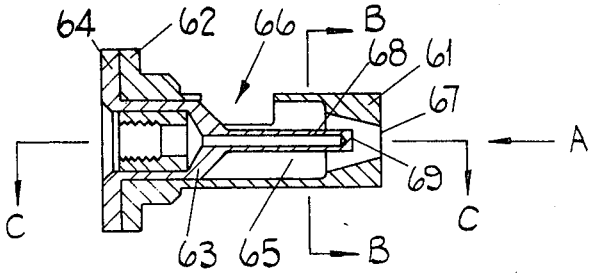
Figure 16:
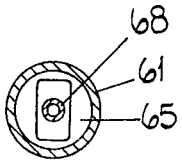
Figure 17:
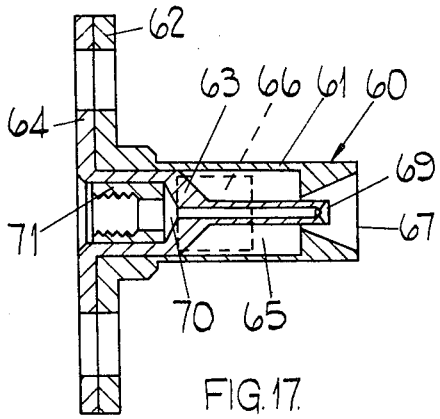
Figure 18:
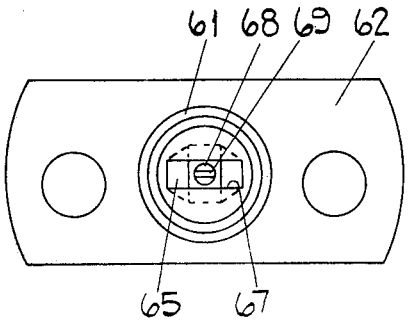

FIG. 7 is a view of the liquid sprayer of FIG. 1 in the direction of arrow B, FIG. 8 is a longitudinal sectional view of another form of liquid sprayer, also according to the present invention, FIG. 9 is a section on the line B—B of FIG. 8, FIG. 10 is a section on the line C—C of FIG. 8, FIG. 11 is a section on the line D—D of FIG. 8, FIG. 12 is an end view, in the direction of arrow E, of the sprayer of FIG. 8, FIG. 13 is an enlarged, sectional view of the encircled portion of FIG. 8, FIG. 14 is a sectional view of an alternative arrangement to that illustrated in FIG. 13, FIG. 15 is a longitudinal section view of a further form of liquid sprayer according to the present invention, FIG. 16 is a section on the line B—B of FIG. 15, FIG. 17 is a section on the line C—C of FIG. 15, and FIG. 18 is a view, in the direction of arrow A, of the liquid sprayer illustrated in FIG. 15.

Referring to FIGS. 1 to 7, the liquid sprayer illustrated therein is a double sprayer and is adapted to be mounted in the combustion chamber wall of a gas turbine engine so as to direct two streams of fuel/air mixture into the combustion chamber, one stream into a first or pilot combustion zone and the other stream into a second or main combustion zone. The liquid sprayer comprises a composite body 20 having a pair of first passages 21 and 22 extending therethrough. The first passages 21 and 22 have respective air inlet openings 23 and 24 and respective exit openings 25 and 26. Both of the first passages 21 and 22 have changing, rectangular cross-sectional shapes. As can be seen from FIGS. 4 and 5, the cross-sectional shape of the first passage 21 over a portion thereof adjacent opening 25 changes from one dimension thereof being smaller than the other dimension to the said one dimension being greater than the other dimension. This change or variation in the cross-sectional shape occurs continuously and smoothly over this portion of the passage 21. Similarly, the cross-sectional shape of the passage 22 in a portion thereof adjacent opening 26 changes from one dimension thereof to the other dimension thereof being greater than the said one dimension thereof, the change in cross-sectional shape occurring continuously and smoothly. The cross-sectional areas of the passages 21 and 22 decrease from the respective inlet openings 23 and 24 to respective throats whilst increasing from the respective throats to the respective exit openings 25 and 26.

Opening into the first passage 21 is a series of three second passages 27 leading from a common drilling 28. The second passages 27 open into the region of the throat at which the passage 21 is of square cross-section, i.e., the said one dimension is the same as the said other dimension of the cross-sectional shape. Similarly, a series of three second passages 29 open into the of the throat region at which the passage 22 is of square cross-sectional shape. The second passages 29 communicate with a common drilling 30.

In FIGS. 2 to 7 of the drawings, the dimensions $g$ to $r$ are as follows (in inches):

$g = 0.250$; $h = 0.466$; $j = 0.250$; $k = 0.740$ $l = 0.335$; $m = 0.625$; $n = 0.335$; $o = 0.989$ $p = 0.460$ $q = 0.690$ and $r = 0.250$ In use, air passes through passage 21 from opening 23 to opening 25 and, in so doing, the flow pattern of the air in passage 21 changes as a result of the changing cross-sectional shape of passage 21. At the same time, pilot fuel is passed into drilling 28 and through second passages 27 to enter into the air stream passing through passage 21. Efficient mixing of the fuel with the air occurs as a result of the changing cross-sectional shape and the fuel/air mixture leaves passage 21 by way of exit opening 25 to be discharged into the first or pilot combustion zone as aforementioned. In a similar manner, air passes through passage 22 from opening 24 to exit opening 26 and a relatively large quantity of fuel is passed into drilling 30 to be ejected into the air stream in passage 22 through passages 29. Again, as a result of the changing cross-sectional area of passage 22 in the region of passages 29, the pattern of air passing through the passage 22 changes substantially and the fuel issuing into passage 22 is efficiently mixed with the air so that a fuel/air mixture is ejected from exit opening 26 and into the second or main combustion zone of the gas turbine engine.

Referring now to the embodiment of FIGS. 8 to 13, the liquid sprayer illustrated therein is designed to inject a fuel/air mixture into the combustion chamber of a gas turbine engine. The fuel sprayer comprises a composite body 40 consisting of a drilled and machined block 41 and a sleeve 42 surrounding the block 41.

Formed in the body 40 is an air passage 43 having an inlet opening 44 and an outlet opening 45. A portion of the air passage 43 in the region of outlet opening 45 is of generally rectangular cross-sectional shape which changes continuously and smoothly from one dimension being smaller than the other dimension (see FIG. 11) to the said one dimension being larger than the other dimension (see FIG. 12) at the outlet opening 45. At an intermediate region of the air passage 43, which is of substantially square cross-sectional shape, a pair of opposed fuel passage 46 open into the passage 43. The passages 46 are connected with an annular space 47 supplied with fuel through a drilling 48 (see FIG. 9). In a recess 49 in the block 41 there is provided an internally screw-threaded bush 50 to enable a fuel supply line having a threaded union thereon (not shown) to be engaged with the bush 50 for supplying fuel to recess 49 and drilling 48. The block 41 is provided with an integral apertured flange 51 to enable the liquid sprayer to be mounted in the gas turbine engine. The cross-sectional area of the air passage increases from the intermediate region to the outlet opening 45.

In use, air passes through passage 43 from the inlet opening 44 to the outlet opening 45 thereof. As the air passes through the portion of the passage 43 which changes in cross-sectional shape, the cross-sectional shape of the air changes also. Fuel is passed into the air passage 43 at a location at which the cross-sectional shape of the passage 43 is substantially square, the fuel being passed through passages 46, annular space 47, drilling 48, and recess 49. The change in shape of the cross-sectional area of the air passing through passage 43 enables an efficient mixing of the fuel injected into passage 43 so that an intimate mixture of fuel and air is ejected from exit opening 45.

In the alternative arrangement illustrated in FIG. 14, the two passages 46 are replaced by a single passage 52 formed as a slot in a hypodermic tube 53 which extends diametrically across block 41 and opens at its ends into annular space 47. The passage 52 open into the passage 43 at a location at which the passage 43 is of substantially square cross-sectional shape.

Referring now to the embodiment of FIGS. 15 to 18, the liquid sprayer illustrated therein is also for use in a gas turbine engine. The sprayer comprises a composite body 60 formed by an outer sleeve 61 having an integral flange 62 thereon, and a boss 63 which fits into the sleeve 61 and has an integral flange 64 which lies against flange 62 an air passage 65 is defined in the body 60 between the sleeve 61 and boss 63. The air passage 65 has an air inlet opening 66 and an air exit opening 67. A portion of the air passage 65 adjacent the exit opening 67 is of a rectangular cross-sectional shape which changes smoothly longitudinally of the passage. The boss 63 is provided with a hollow tubular projection 68 which terminates in said portion of air passage 65. A passage 69 in the form of a flared slot is provided in the end of the tubular projection 68 remote from boss 63, said passage 69 communicating with the interior of tubular projection 68. The interior of tubular projection 68 in turn communicates with a drilling 70 formed in the boss 63 and accommodating an internally screw-threaded bush 71 into which is threaded one end of a fuel supply line (not shown).

As in the case of the previous embodiment, the portion of the passage 65 which is of rectangular cross-section changes in shape from one dimension being smaller than the other (see FIG. 16) to the said one dimension being larger than the other (see FIG. 18). The passage 69 opens into an intermediate portion of passage 65 at which the passage 65 is of square cross-sectional shape. The cross-sectional area of the passage 69 increases from the intermediate portion to the exit opening 67.

In use, the fuel sprayer is mounted in the desired position in the gas turbine engine using flanges 62 and 64. Air passes through passage 65 from air inlet opening 66 to exit opening 67 and fuel is sprayed into the passage 65 through passage 69 from the interior of tubular projection 68 and drilling 70. The fuel is intimately mixed with the air in passage 65 as a result of the change in cross-sectional shape of the passage 65 and therefore of the air flow pattern. The resultant fuel/air mixture issues from the liquid sprayer through exit opening 67.

We claim:

1. A liquid sprayer comprising a first passage through which, in use, gaseous fluid passes, and a second passage through which, in use, liquid passes, said first passage having a cross-sectional area which decreases from an inlet plane thereof to a throat and increases from said throat to an outlet plane thereof, and said second passage opening into the first passage at a point in the region of said throat where the cross-sectional area is less than the cross-sectional area at said outlet plane, the cross-sectional shape of said first passage in said region of said throat changing from one dimension thereof being smaller than the other dimension to said one dimension being greater than said other dimension.

2. The liquid sprayer according to claim 1, wherein said second passage opens into said first passage at a location at which said one dimension is substantially the same as said other dimension.

3. The liquid sprayer according to claim 1, wherein said first passage in said region of said throat varies continuously and smoothly in cross-sectional shape.

4. The liquid sprayer according to claim 1, wherein said first passage is of changing rectangular cross-section.

5. The liquid sprayer according to claim 1, having more than one first passage and more than one second passage associated therewith.

* * * * *